US006250362B1

(12) United States Patent
Rioja et al.

(10) Patent No.: US 6,250,362 B1
(45) Date of Patent: Jun. 26, 2001

(54) METHOD AND APPARATUS FOR PRODUCING A POROUS METAL VIA SPRAY CASTING

(75) Inventors: Roberto J. Rioja, Murrysville; Men G. Chu, Export; Gregory J. Hildeman; David D. Leon, both of Murrysville; Robert L. Kozarek, Apollo, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/033,248

(22) Filed: Mar. 2, 1998

(51) Int. Cl.[7] ..... B22D 23/00; B22D 27/20
(52) U.S. Cl. ..... 164/46; 164/79
(58) Field of Search ..... 164/46, 79, 66.1, 164/67.1, 68.1; 75/415

(56) References Cited

U.S. PATENT DOCUMENTS

| | | | | |
|---|---|---|---|---|
| 4,422,229 | | 12/1983 | Sadler et al. | 29/156.8 H |
| 4,905,899 | * | 3/1990 | Combs et al. | 164/46 |
| 4,973,358 | | 11/1990 | Jin et al. | 75/415 |
| 5,112,697 | | 5/1992 | Jin et al. | 428/613 |
| 5,181,549 | | 1/1993 | Shapovalov | 164/79 |
| 5,281,251 | | 1/1994 | Kenny et al. | 75/415 |
| 5,301,415 | | 4/1994 | Prinz et al. | 29/458 |
| 5,301,863 | | 4/1994 | Prinz et al. | 228/33 |
| 5,334,236 | | 8/1994 | Sang et al. | 75/415 |
| 5,343,926 | * | 9/1994 | Chesk's et al. | 164/46 |
| 5,472,038 | | 12/1995 | Forrest et al. | 164/46 |
| 5,483,864 | * | 1/1996 | Vanavk et al. | 164/46 |

FOREIGN PATENT DOCUMENTS

| | | | | |
|---|---|---|---|---|
| 0191008 | | 8/1986 | (EP) . | |
| 1156565 | | 7/1969 | (GB) . | |
| 109559 | | 8/1980 | (JP) . | |
| 312013 | | 12/1989 | (JP) . | |
| 1-312013 | * | 12/1989 | (JP) | 164/46 |
| 123861 | | 4/1992 | (JP) . | |
| 9203582 | | 3/1992 | (WO) . | |

* cited by examiner

*Primary Examiner*—Kuang Y. Lin
(74) *Attorney, Agent, or Firm*—Debra Z. Anderson; Gary P. Topolosky

(57) ABSTRACT

A method and apparatus is provided for producing a porous metal. The method broadly includes the steps of first, providing a molten metal and second, introducing a gas into said molten metal. The method then includes spray casting the molten metal containing the gas onto a surface thereby producing the porous metal. The method further provides for controlling the amount and size of the porosity contained within the porous metal by controlling the parameters at which the gas is introduced into the molten metal, as well as, controlling the parameters surrounding the spray casting of the molten metal. Additionally, the method also provides for producing a porous metal having either an isolated or interconnected pore structure. The present invention also provides for a porous metal product, as well as a porous aluminum alloy product, made by the described method. The apparatus includes a means for containing the molten metal wherein the containing means has a discharge end. A means for introducing a gas into the containing means is also provided. The apparatus further includes molten metal discharge means positioned adjacent the discharge end of the containing means for atomizing the molten metal that is discharged from the discharge end into metal droplets, and a substrate on which the metal droplets are deposited in order to form the porous metal.

20 Claims, 11 Drawing Sheets

Effect of Lithium on the Solubility of Hydrogen in Aluminum at 1.01 bar Hydrogen pressure Optical Photomicrographs of an Al-2% Li Alloy Saturated with Hydrogen at 973K and 1.01 bar Hydrogen Pressure; Cooled in Hydrogen Atmosphere. Note the Segregation of Hydrogen-Induced Porosity at the Grain Boundaries Spray Cast Porous Materials Aluminum Alloy 6061 (50X Magnification)

Small pores

Medium pores

Large Pores

Spray Cast Porous Materials
Expanded Products ( 7.5 X Magnification)

Alloy 6061

Alloy C-155

Spray Cast Porous Materials
Expanded Products (50 X Magnification)
Different types of expanded microporosity Alloy 6061

Spray Cast Porous Materials
Expanded Products (50 X Magnification)
Different types of expanded microporosity Alloy C-155

METHOD AND APPARATUS FOR PRODUCING A POROUS METAL VIA SPRAY CASTING

BACKGROUND OF THE INVENTION

The present invention relates to a method and apparatus for producing a porous metal via spray casting. The method is particularly well suited for producing a porous metal, and more particularly a porous aluminum alloy, where it is desirable to control levels of porosity within the porous product.

Porous metal, also referred to as metal foam, is known and has been in existence, in varying forms, for several decades. Porous metals typically are categorized as either having an "isolated" pore structure (having discrete, non-interconnected pores) or having an "interconnected" pore structure (comprised essentially of a lattice work of metal in a porous network).

Porous metals provide for a lightweight material possessing a unique combination of properties which makes them an attractive material for a variety of applications. The properties of a porous metal are dependent upon the density, the size, shape, and distribution of porosity, and the alloy and temper of the base material. Examples of porous metal properties, of particular commercial interest, include low density, high specific stiffness, and good energy and sound absorption capabilities. Additional properties of porous metals which can be controlled as a function of density include specific strength, electrical and thermal conductivity, vibration dampening capacity, fire and explosion resistance, electromagnetic shielding capabilities, buoyancy (isolated pore structure), and high surface area (interconnected pore structure). Another feature making porous metal materials attractive for a variety of uses is that they are readily fabricated into finished products, including the use of cutting and machining, brazing, mechanical fastening, adhesive bonding, plating, anodizing, and painting. Thus, it will be appreciated that the combination of unique properties provided by porous metals makes it an attractive material for a variety of automotive and aerospace applications, as well as, many other applications where the exhibited properties of porous metals are desirable.

Techniques for manufacturing or producing porous metals are also known and two of the most well recognized techniques include: 1) powder metallurgical techniques; and 2) molten metal processing techniques.

The powder metallurgy techniques usually begin with a mixture of a metal powder and a foaming agent, or a powdered alloy of the metal and foaming agent, being produced and solidified under pressure, then ground into a powder material. The powders are then evenly distributed on a vibrating conveyer which carry them through a heating chamber where the metal is melted and the foaming agent decomposed. (See, for example, U.S. Pat. Nos. 2,979,392 and 3,214,265). Other more conventional powder metallurgical techniques to produce porous metals include a powder and a foaming agent being mixed, compacted, and extruded at a temperature below the decomposition temperature of the foaming agent, to form a fully dense, solid extrusion. This extruded bar or rod is then heated, perhaps in a mold, to above the melting temperature of the base material to produce porous metal. (See, for example, U.S. Pat. No. 3,087,807). Processes utilizing powder technology are not desirable because they require multiple steps, such as powder atomization, collection, compaction and sintering. These factors are difficult to control. In addition, powder material requires special handling making its use more difficult and less desirable.

The molten metal processing techniques for producing a porous metal generally include adding a gas evolving compound or soluble gas to a molten metal. This results in the creation of a foam which is collected, cooled and solidified so as to form a solid of foamed metal. One difficulty with molten metal processing is the necessity of stabilizing the foam prior to solidification in order to prevent collapse of the levels of foam and to control the uniformity of the foam.

However, these techniques, as well as others, for producing porous metals all share inherent disadvantages, the most significant of which is the complexity of the production processes. Of course, this translates into higher costs for porous metal products.

Thus, there is identified a need for producing a porous metal which is less complex than present state of the art techniques, enabling manufacturing and production costs to be lowered so as to increase uses and acceptability of porous metals as a viable material. The method for producing a porous metal should be capable of producing a porous metal exhibiting the desired characteristics and properties which make porous metals an attractive material for numerous applications.

Spray casting, also known as spray forming, of molten metal is a well-known process for producing various types of metal products. However, spray forming techniques have not heretofore been utilized for producing porous metal with controlled levels of porosity having a desired size, shape or distribution for specific applications primarily because production of high density products is the primary goal for spray forming processes. Spray casting consists of introducing a controlled stream of molten metal into a gas-atomizing nozzle where it is impacted by high-velocity jets of gas, usually argon or nitrogen. The resulting spray of metal droplets is deposited onto a surface, such as a substrate or mold, to form a metal product. (See, for example, U.S. Pat. Nos. 4,938,278; 5,110,631; 5,143,140; and 5,154,219.)

In terms of the metal product produced, spray casting has several advantages over metal products produced by traditional ingot, roll or slab casting techniques. Spray cast metal products have extremely fine and uniform microstructure and composition. In addition, because of the rapid solidification inherent in the spray forming process, certain alloys containing high levels of alloy elements, such as aerospace aluminum alloys, that are difficult to cast in ingots or strips by roll or belt casters can be successfully made by spray casting processes.

SUMMARY OF THE INVENTION

The present invention has met or exceeded the above mentioned needs as well as others. More particularly, the present invention provides a method for producing a porous metal including the steps of first, providing a molten metal and second, introducing a gas into the molten metal. The method then includes spray casting the molten metal containing the gas onto a surface, such as a substrate or mold, to produce the porous metal. More specifically, the present invention provides for controlling the amount, size and distribution of the porosity contained within the porous metal by controlling the parameters at which the gas is introduced into the molten metal, as well as, controlling the gas atomizing parameters surrounding the spray casting of the molten metal. The method of the present invention also provides for producing a porous metal having either an isolated or interconnected pore structure.

Further, the present invention includes a porous metal product made by the above method, as well as, a porous aluminum alloy product made by the above method.

The present invention also provides an apparatus for spray casting a molten metal into a porous metal. The apparatus comprises a means for containing the molten metal wherein the containing means has a discharge end. A means for introducing a gas into the containing means is also provided. The apparatus further comprises molten metal discharge means positioned adjacent the discharge end of the containing means for atomizing the molten metal that is discharged from the discharge end into metal droplets, and a surface onto which the metal droplets are deposited in order to form the porous metal.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1A:
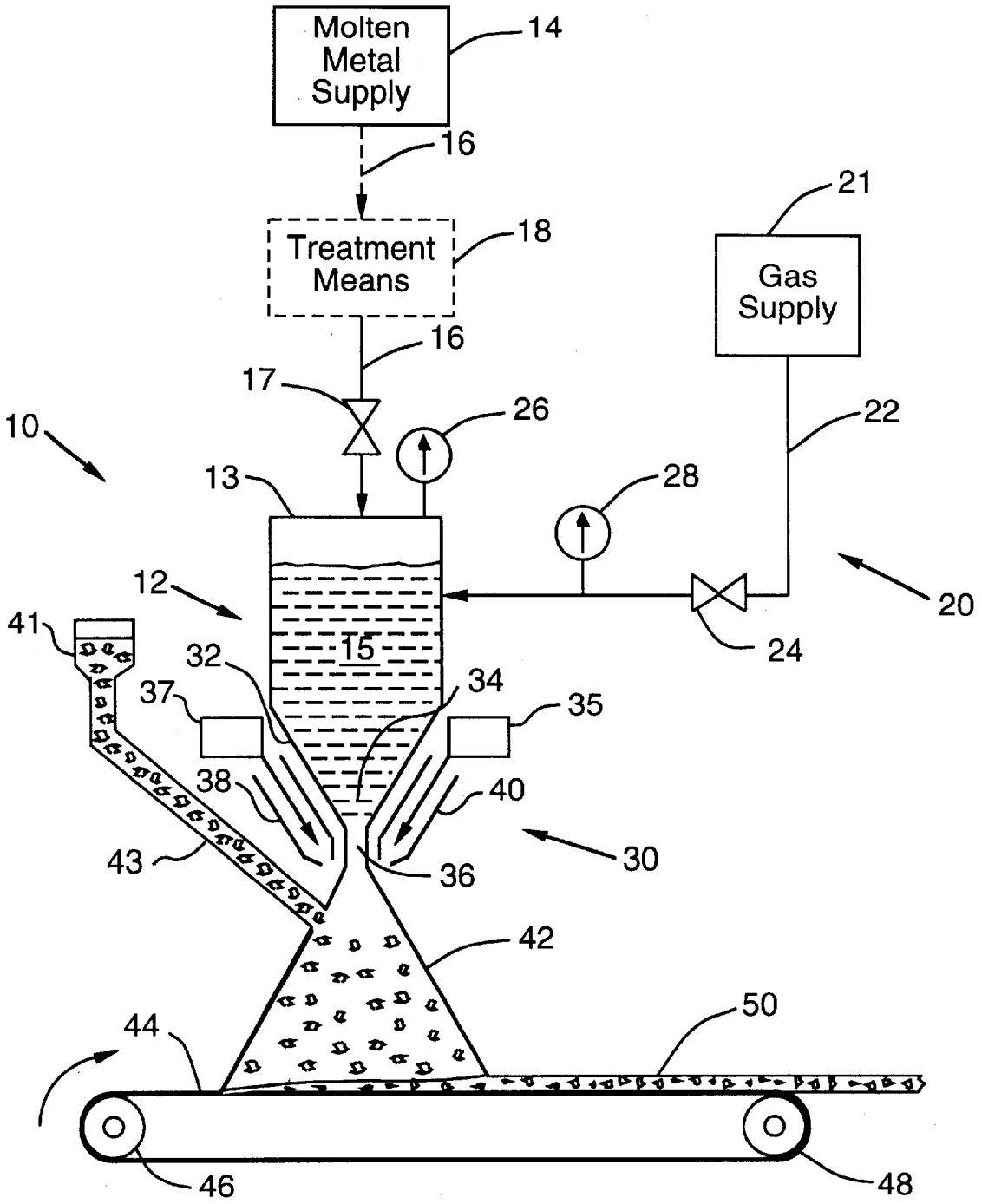
FIG. 1*a* is a schematical sectional view of the spray casting apparatus of the present invention illustrating a continuous process for producing a porous metal product.

Reference is now made to FIG. 1*a* showing the spray casting apparatus 10 of the present invention. As shown, the spray casting apparatus 10 includes a containing means, generally designated by reference numeral 12, which includes a tundish 13 for containing a molten metal 15. As is known in the art, the molten metal 15 may be delivered to tundish 13 from a molten metal supply source 14 via feedline 16 and, if desired, the molten metal may be passed through treatment means 18 for treatment, such as removing unwanted impurities by degasification or filtration, prior to being delivered to the tundish 13. The spray casting apparatus 10 further includes gas introducing means 20 for introducing a gas into the containing means 12, and more specifically, into the molten metal 15 contained in the tundish 13. The gas introducing means 20 includes a pressurized gas source 21 which is connected to feedline 22 for delivering the gas at a pressure controlled by valve 24. The pressure within the tundish 13 may be monitored by pressurization gauge 26 and the flow rate of gas into the tundish 13 may be monitored by flow control gauge 28.

Figure 1B:
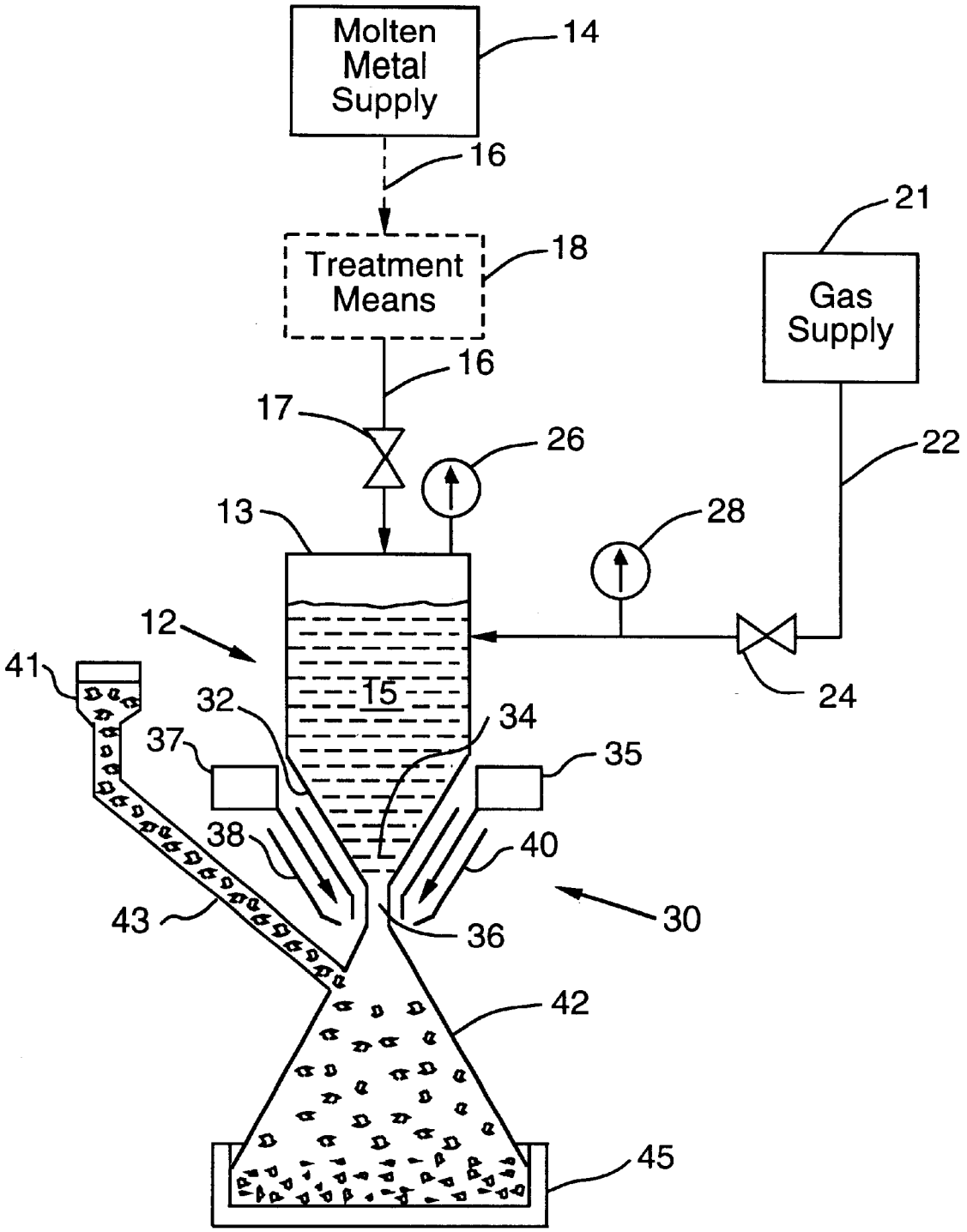
FIG. 1*b* is similar to FIG. 1*a* but shows a spray casting apparatus to produce a porous metal shape, i.e., using a mold rather than a continuous process.

Further describing the spray casting apparatus 10, a molten metal discharge means 30 is provided adjacent a discharge end 32 of containing means 12. The molten metal discharge means 30 includes a nozzle 34 having a discharge opening 36 through which the molten metal 15 is delivered. Upon exiting the discharge opening 36, the molten metal 15 is impinged upon by high velocity jets of atomizing gas, such as jets 38 and 40, originating from gas atomizing supplies 35 and 37 as is known in the art. In accordance with the present invention, the atomizing gas may be argon, nitrogen, hydrogen, helium, $SF_6$, air, oxygen, $CO_2$ and combinations thereof or other suitable gaseous substance. The jets of gas atomize the molten metal 15 being discharged from the discharge opening 36 of the nozzle 34 so as to produce numerous metal droplets (not shown) which collectively make up a plume 42 of molten metal droplets that are deposited onto a surface, such as in a preferred embodiment a continuously moving substrate 44 (FIG. 1*a*). In another embodiment, the molten metal droplets may be deposited onto a mold 45 (FIG. 1*b*) or, in a further embodiment, sprayed directly into the gap of cooled or heated rolls (not shown).

Further referring to FIG. 1*a*, the substrate 44 is shown as an endless belt which orbits two rollers 46 and 48 which allows for the buildup of the metal droplets so as to produce a porous metal 50. The porous metal 50 continues along the substrate 44 until it is separated therefrom and placed in a position for further processing, as will be described in greater detail below.

The spray casting apparatus 10 may also include a particle injector 41 for introducing solid particles 43 into the spray of the molten metal droplets before depositing the metal droplets onto the substrate 44. Advantageously, by adding the solid particles 43, the properties of the solidified porous metal 50 are enhanced. The particles 43 may be, for example, reinforcing fibers or particles to increase properties such as modulus as in making a metal matrix composite. Additionally, the particles 43 may be hollow spheres to provide a different type of porosity. Furthermore, the particles 43 may be porous particles, such as fly ash or alumina to provide a different type of porosity. In the case of introducing porous particles, the porous particles could be impregnated with a substance useful for later use such as, for example, the porous particles could be impregnated with salts which will decompose into gaseous species upon heating and yield to the creation of further porosity.

In accordance with the present invention, a method for producing a porous metal is provided wherein the steps of the method may be broadly described as providing a molten metal, introducing a gas into the molten metal and spray casting the molten metal containing the gas onto a surface so as to produce a porous metal. Spray casting of a porous metal advantageously allows for greater control of the size, amount and type of porosity which may be present in the porous metal. Further, the use of spray casting to produce a porous metal is advantageous, when compared to previous techniques for producing porous metals, because current processes, such as foaming the molten metal, yields products with very low mechanical properties, such as tensile yield strength and elongation. In contrast, the spray casting method of the present invention yields porous products with significantly increased properties, such as tensile yield strength and elongation, and the product can be subjected to wrought deformation either by hot or cold working or by the expansion of the entrapped gas. Other processes, such as making a porous product from metal powders, are cumbersome to control and require many more steps and a higher cost than the present invention.

Referring once again to the spray casting apparatus 10 as shown in FIG. 1*a* and described above, the method of the present invention will now be described in more detail. As described, the method first includes providing a molten metal 15 which may be any base metal material from which it is desired to produce a porous metal. The base metal material is provided in the molten state in order to accommodate the production of a porous metal using spray casting. As described, a molten metal supply source 14 may be provided for delivering the molten metal 15 to the containing means 12. This is accomplished via feedline 16 and pressure valve 17 which enables for the pressure to be maintained within the containing means 12. Depending upon the grade of base metal material which is being used, a treatment means 18, shown in phantom line, may be provided for purposes such as cleaning the base metal material to remove any unwanted impurities. The base metal material may also be degasified within the treatment means 18 so as to control the amount of gas contained within the molten metal 15. The amount of gas contained within the molten metal 15 will have an effect on the porosity present within the porous metal being produced, as will be described in more detail below. It should be appreciated that the molten metal 15 may be supplied as described herein or by any other similar means which is known.

Once the molten metal 15 is provided to the containing means 12, and more specifically provided to the tundish 13, the method of the present invention then calls for introducing a gas into the molten metal 15. This is accomplished by using the gas introducing means 20, as shown in FIG. 1, wherein the gas is introduced via feed line 22. The gas may be introduced directly into the molten metal 15 or may be introduced into the tundish 13 and then mixed with the molten metal. Depending upon the parameters at which the gas is being introduced into the molten metal 15, the gas is soluble in the molten metal and during solidification of the porous metal following the spray casting, certain amounts of the gas precipitates to form porosity which will remain entrapped in the solidified metal. Thus, it should be appreciated that by controlling the parameters surrounding the introduction of gas into the molten metal 15, the present invention allows for controlling the formation of porosity which will ultimately be present in the resulting porous metal product being produced by spray casting.

Figure 6:
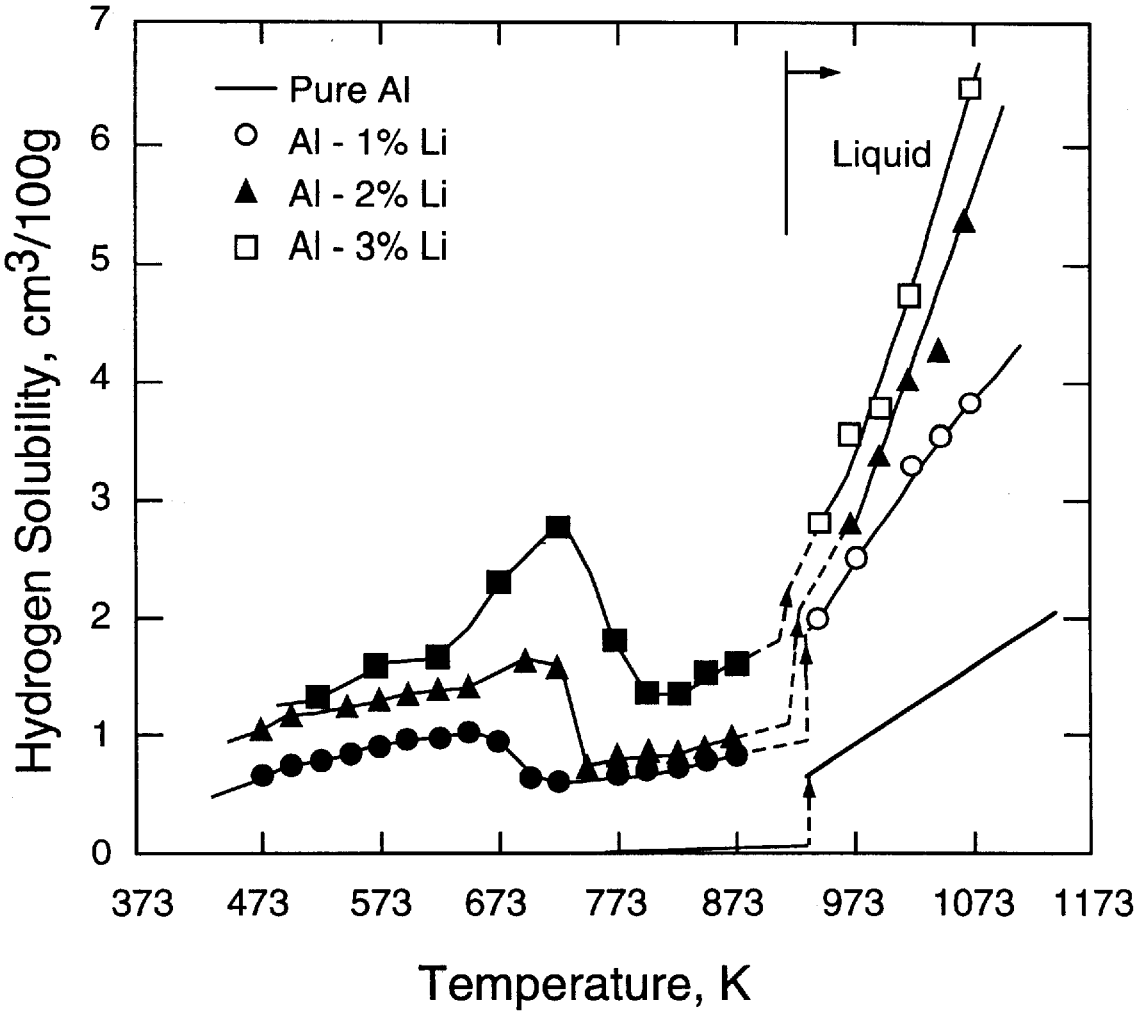
FIG. 6 is a graph showing the effect of temperature on the solubility of hydrogen in liquid and solid aluminum metal, as well as, shows the changes in solubility as different amounts of an alloying element are added. This particular graph represents the solubility of hydrogen in aluminum at 1.01 bar hydrogen pressure.

The parameters primarily affecting the formation of porosity include the type of gas which is introduced, the pressure of the gas and the temperature of the molten metal 15. The type of gas used in conjunction with the present invention may include, for example, argon, nitrogen, hydrogen, helium, $SF_6$, air, oxygen, $CO_2$, and combinations thereof or other suitable gaseous substance. Of course, the pressure of the gas and the temperature of the molten metal 15 are further dependent upon the type of gas being used as well as the type of molten metal being utilized. For example, FIG. 6 shows the solubility of hydrogen gas in aluminum-lithium alloys. As shown, the alloy composition and the temperature of the molten metal both determine the solubility of hydrogen at the liquid state.

Thus, it will be appreciated that the introduction of a gas into the molten metal 15, and the parameters surrounding the introduction as described herein, play an important role in the development of the porosity within the porous metal. More specifically, the gas which precipitates during solidification of the porous metal so as to establish the desired porosity actually results in the formation of microporosity. This microporosity is illustrated in FIG. 2 showing a sectional view of the porous metal 50 and the microporosity is generally designated by the reference numeral 52.

Figures 7A, 7B:
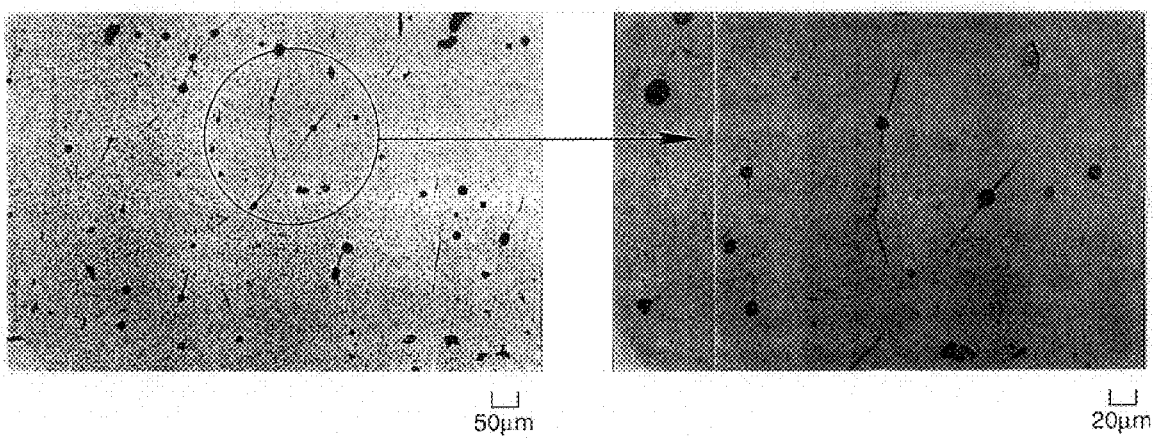
FIGS. 7*a* and 7*b* are prior art photomicrographs showing porosity developed in an aluminum alloy saturated with hydrogen.
Figures 8A, 8B, 8C:
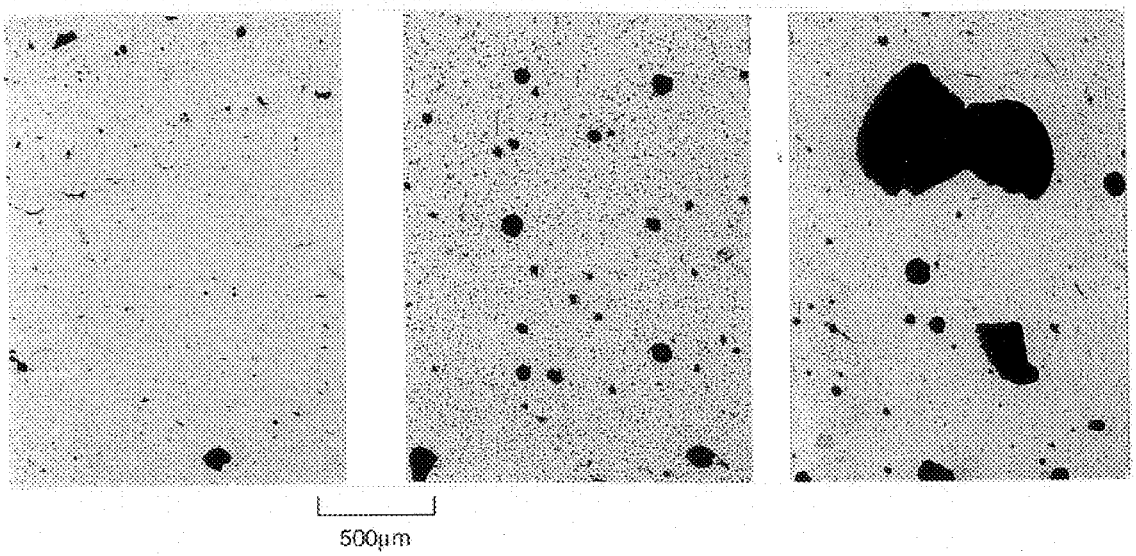
FIGS. 8*a*–8*c* show photomicrographs of spray cast samples using aluminum alloy 6061 at 50×magnification.
Figures 9A, 9B, 9C:
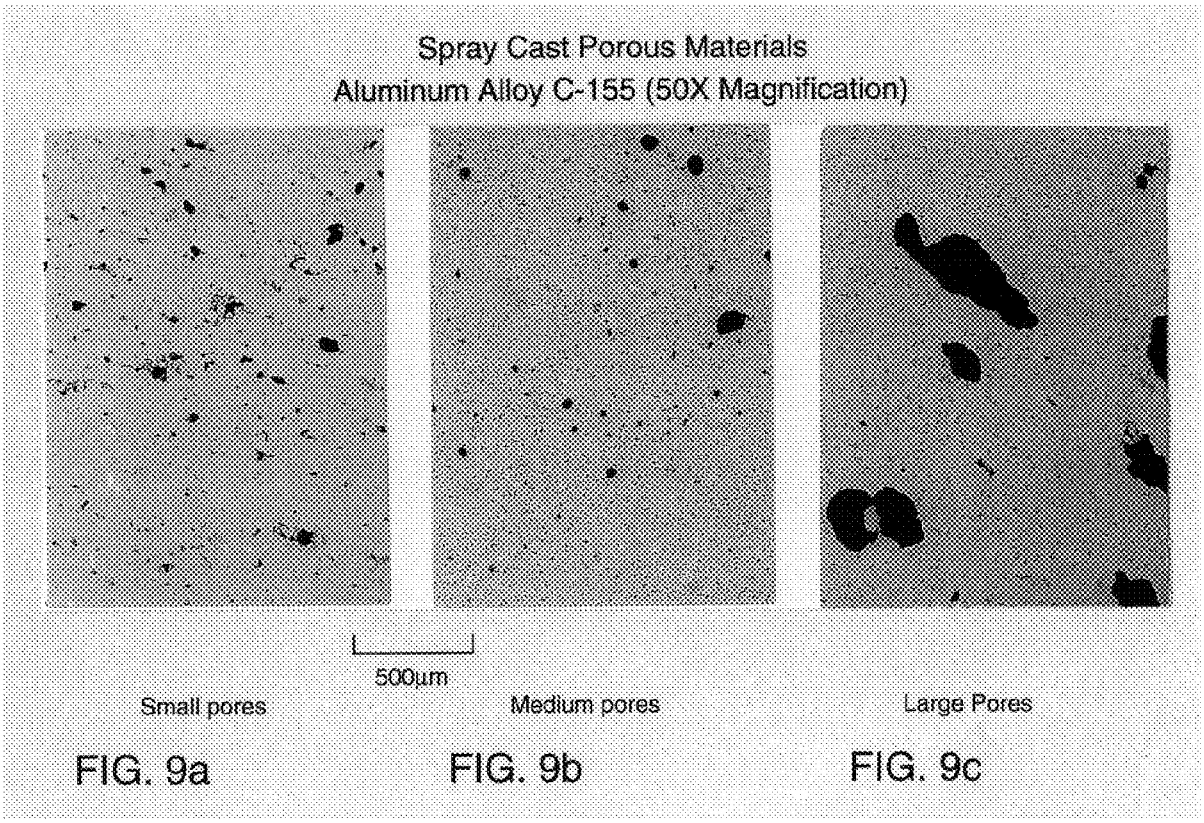
FIGS. 9*a*–9*c* show photomicrographs of spray cast samples using aluminum alloy C-155 (Al—Cu—Li*13 Zn—Mg) at* 50×magnification.

FIGS. 7*a*, and the enlarged portion of FIG. 7*a* shown in FIG. 7*b*, show microporosity developed during precipitation of hydrogen gas in an aluminum alloy. This microporosity, upon heating of the metal sample, leads to the formation of pores due to expansion of the entrapped hydrogen gas. In typical prior art metal production processes, such microporosity was not desirable and was eliminated or reduced to a minimum amount if possible. This is in contrast to the present invention which provides for the introduction of porosity of varying sizes, i.e., microporosity and macroporosity, as will be discussed herein below, so that a porous metal may be produced.

Following the introduction of a gas into the molten metal 15, the method of the present invention then provides for spray casting the molten metal containing the introduced gas onto the substrate 44 so as to produce the porous metal 50. This is accomplished using the molten metal discharge means 30, as shown in FIG. 1*a*, which includes the nozzle 34 having a discharge opening 36 for discharging the molten metal 15 at which point the molten metal is impinged upon by the high velocity jets of atomizing gas 38 and 40. Such a molten metal discharge means 30 is typically known in the art and used in conjunction with known spray casting techniques. Of more importance for purposes of describing the present invention are the operating parameters which are associated with the molten metal discharge means 30. By controlling these operating parameters, as will be described in more detail below, it is possible to further control the formation of porosity which will exist within the porous metal 50. Whereas the introduction of a gas into the molten metal 15, as described previously, resulted in the formation of microporosity, subjecting the discharged molten metal 15 to the jets of atomizing gas 38 and 40 also results in the formation of porosity, and more specifically macroporosity.

Figure 2:
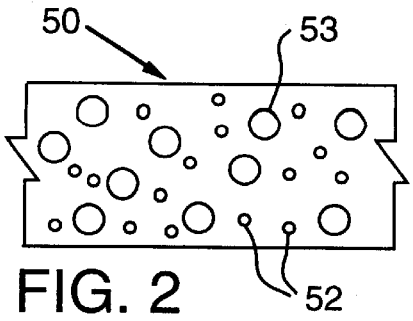
FIG. 2 is a sectional view of a porous metal, produced in accordance with the present invention, showing the presence of both macroporosity and microporosity within the porous metal.

An illustration of this macroporosity is shown in FIG. 2 wherein the macroporosity is designated by the reference numeral 53.

FIGS. 8*a*–8*c* and FIGS. 9*a*–9*c* show examples of both macroporosity and microporosity in spray-deposited alloys 6061 (Al—Mg—Si Base) and C-155 (Al—Cu—Li Base), respectively. In these figures, the larger pores or macroporosity, generally larger than 100 $\mu$m, are the result of atomizing the metal droplets and the exact size of these pores is dictated by the atomization parameters. In addition, the smaller pores or microporosity, generally smaller than 100 $\mu$m, are the result of the gas being introduced into the molten metal as described herein above and the exact size of these pores is dictated by the parameters at which the gas is introduced into the molten metal as discussed herein. FIGS. 8*a*–8*c* and 9*a*–9*c* show that spray casting results in the formation of pores of varying sizes.

The pressure of the atomizing gas is one parameter which effects the formation of macroporosity 53. The higher the gas pressure, the finer the atomized particle size which, in turn, results in the lower the fraction of liquid in the spray. This results in higher density with lower amounts of macroporosity 53.

The temperature of the atomizing gas also effects the formation of macroporosity 53. Generally, the amount of macroporosity 53 will increase with increasing atomizing gas temperature.

In addition, the temperature of the molten metal 15 which is introduced into the nozzle 34 has an effect on the amount of macroporosity 53 formed. The amount of macroporosity 53 increases with increasing molten metal temperature. A minimum of 50° C. superheat is desirable.

The flow rate of the atomizing gas also effects the formation of macroporosity 53. The amount of macroporosity 53 is affected by the gas/metal ratio. The smaller the ratio, the higher the amount of macroporosity 53.

Thus, it will be appreciated that by controlling the parameters associated with the molten metal discharge means 30, as described herein, it is possible to control the formation of porosity, and particularly macroporosity 53, that will be present in the resulting metal foam 50 being produced. Typical sizes for macroporosity 53 range from about 100 $\mu$m to several millimeters in diameter. Volume fractions can vary from less than 1 percent to about 25–50 volume percent.

The spray casting of the molten metal 15 onto the substrate 44 results in the formation of porous metal 50. Advantageously, the porous metal 50 may have varying amounts of porosity based upon the many parameters concerning the introduction of the gas into the molten metal 15, as well as, the many parameters associated with the molten metal discharge means 30. By predetermining the amount of porosity which is needed or desired within a particular porous metal product being produced, the parameters may be adjusted accordingly so as to obtain the desired porous metal product. Once formed on the substrate 44, the porous metal 50 is separated therefrom in any manner known in the art and maintained for later processing.

Figure 3A:
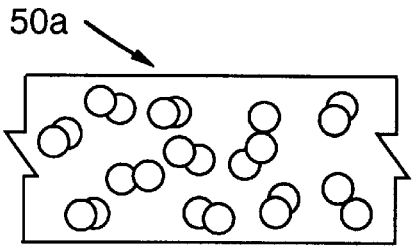
FIG. 3*a* is a sectional view of a porous metal, produced in accordance with the present invention, having an interconnected pore structure.
Figure 3B:
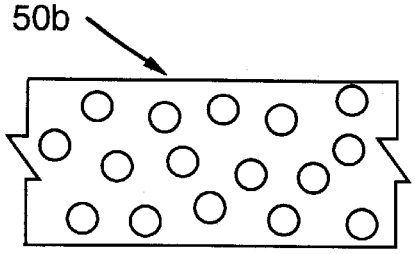
FIG. 3*b* is a sectional view of a porous metal, produced in accordance with the present invention, having an isolated pore structure.

In accordance with another aspect of the present invention, the ability to control levels of porosity within the porous metal 50 provides for the further capability of producing a porous metal 50*a*, as shown in FIG. 3*a*, having an interconnected pore structure wherein the pores are interconnected comprising essentially a lattice work of metal in a porous network. Similarly, a porous metal 50*b*, as shown in FIG. 3*b*, may be produced having an isolated pore structure wherein there is a discrete, non-interconnected arrangement of the pores. Generally, porous materials with greater than 95% density have closed or isolated porosity. For less dense materials, the level of permeability is a function of the size, interconnectivity, and volume fraction of the pores. These are situations where an interconnected pore structure is needed to circulate a fluid through the interior of the porous structure. In this case, large pores and a high volume fraction of pores are desired. In other instances where mechanical properties are of most significance then small pores and a low volume fraction of pores will be desired. While FIGS. 3*a* and 3*b* show the interconnected and isolated pore structures, respectively, for the macroporosity, it should be appreciated that similar type pore structures may be created for the microporosity as well.

Figure 4A:
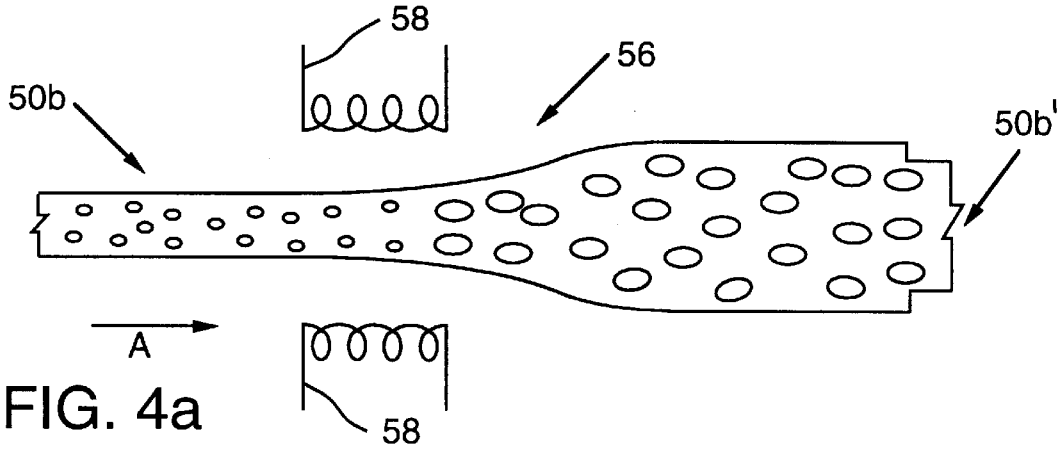
FIG. 4*a* is a sectional view of the porous metal having an isolated pore structure, as set forth in FIG. 3*b*, wherein the porous metal is being induction heated.
Figure 10A:
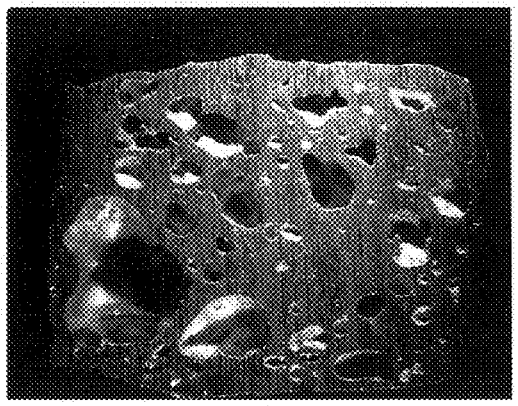
FIGS. 10*a* and 10*b* show photomicrographs of spray cast samples containing porosity and then rapidly heated, via induction heating, to yield expansion of the entrapped gas. The photographs are shown at 7.5×magnification.
Figure 10B:
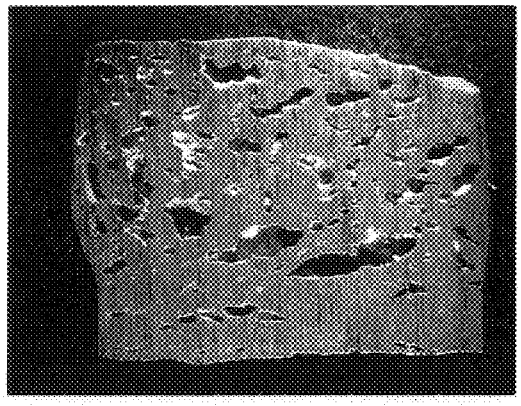
Figures 11A, 11B, 11C:
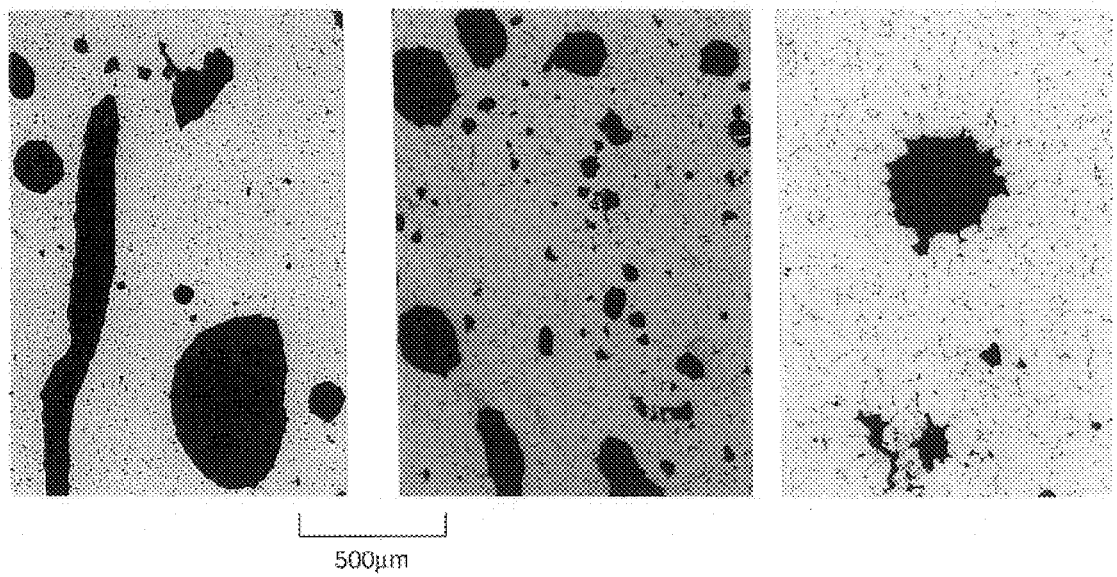
FIGS. 11*a*–11*c* show photomicrographs from spray cast and expanded aluminum alloy 6061 samples, similar to FIGS. 8*a*–8*c*. These samples were expanded by rapid heating and are shown at 50×magnification.
Figures 12A, 12B, 12C:
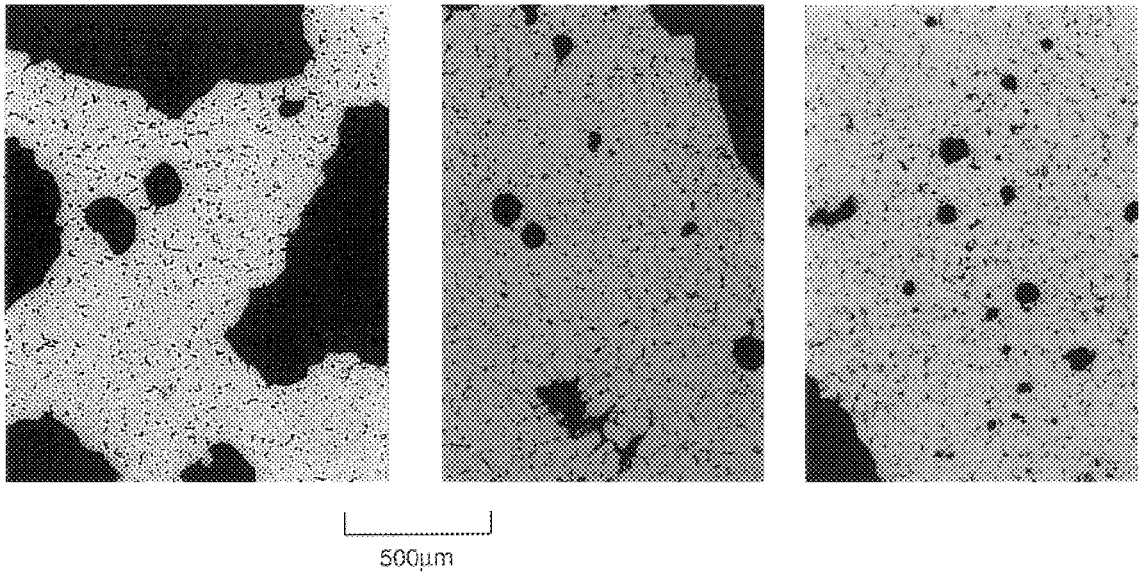
FIGS. 12*a*–12*c* show photomicrographs from spray cast and expanded aluminum alloy C-155 (Al—Cu—Li—Zn—Mg) samples, similar to FIGS. 9*a*–9*c*. These samples were expanded by rapid heating and are shown at 50×magnification.

Following the production of a porous metal 50 by spray casting as described herein, the present invention further may include subjecting the porous metal to thermal mechanical treatments so as to form the porous metal into a predetermined shape. More specifically, the porous metal 50 may be subjected to various methods of forming which expands the porosity contained within the porous metal. The porous metal 50 may be formed by heating so as to control the expansion of porosity contained therein. The heating may be accomplished by conduction, convection or radiation. More specifically, the porous metal 50 is preferably heated by induction, resistance, radiant tubes, infra-red radiation, microwave radiation, laser, electron beam, fluidized bed, as well as any other method of rapid heating generally known in the art. For example, as shown in FIG. 4*a*, porous metal 50*b* may be subjected to induction heating using an apparatus generally designated by reference numeral 56. The apparatus 56 includes induction coils 58 so that when the porous metal 50*b* passes through the heating apparatus 56, in the direction shown by arrow A, the porosity contained within the porous metal may be expanded thereby producing a porous metal 50*b*'. The expansion of the porosity is a result of heating due to an electrical/magnetic field produced by the induction coil 58 which causes the heated gas entrapped within the pores to expand. Alteratively, a die (not shown) may be positioned around the induction coil 58 to control the expansion thus producing a desired or predetermined shape, while at the same time, increasing the size and volume fraction of porosity. While the porous metal 50*b* shows only macroporosity having an isolated pore structure, it should be appreciated that the process of expanding the porosity is equally applicable to microporosity. FIGS. 10, 11 and 12 show the results of spray cast alloy 6061 and C-155 that were subjected to induction heating to yield expansion of the entrapped gases. FIG. 10 shows sections of spray cast porous metal that were covered with an anodized surface layer and induction heated close to 600° C. This treatment resulted in the expansion of the pores shown in FIGS. 8 and 9 into the pores shown in FIG. 10 at 7.5×. Metallographic sections of the expanded products are shown in FIGS. 11 and 12 at 50×.

Similarly, the porous metal 50 formed in accordance with the present invention may be formed into a predetermined shape by heating the porous metal within a constraining die via means other than induction heating. The heating causes the gas entrapped within the porosity to expand and by controlling the expansion, a porous metal having the predetermined shape is achieved. It is preferred to rapidly heat the porous metal to reduce the diffusion of gas out of the porous product.

In accordance with another aspect of the present invention, the porous metal 50 may be subjected to deformation such as hot or cold rolling, extrusion or forging.

Figure 4B:
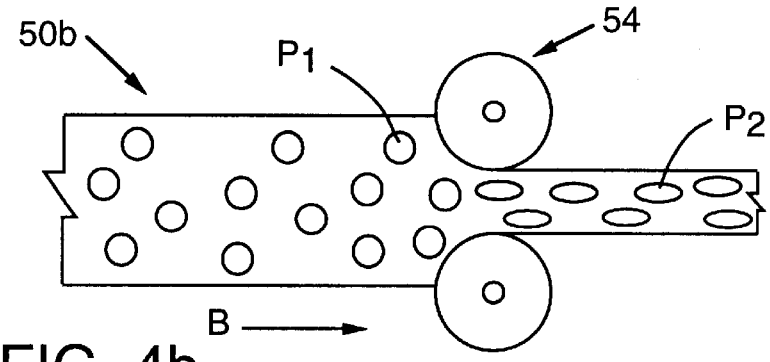
FIG. 4*b* is a sectional view of the porous metal having an isolated pore structure, as set forth in FIG. 3*b*, wherein said porous metal is subjected to wrought deformation.

These treatments may increase the internal pressure of the porous metal. By increasing the pressure of the gas entrapped in the porosity, it is possible to improve the mechanical properties of the final product. FIG. 4*b* shows the porous metal 50*b* being subjected to roll forming using the roll forming apparatus 54. As the porous metal 50*b* moves in the direction of arrow B, the pressure within the pores is increased from an initial pressure of $P_1$ to a higher pressure of $P_2$. This change in internal pressure leads to strengthening of the porous structure. The porous product could also be heated in such a way as to allow diffusion of the entrapped gas and therefore making the material more amenable to forming operations. While FIG. 4*b* shows the porous metal 50*b* as having macroporosity and an isolated pore structure, it should be appreciated that roll forming and other types of metal forming may also be applied to a porous metal containing microporosity or an interconnected pore structure.

Figure 5:
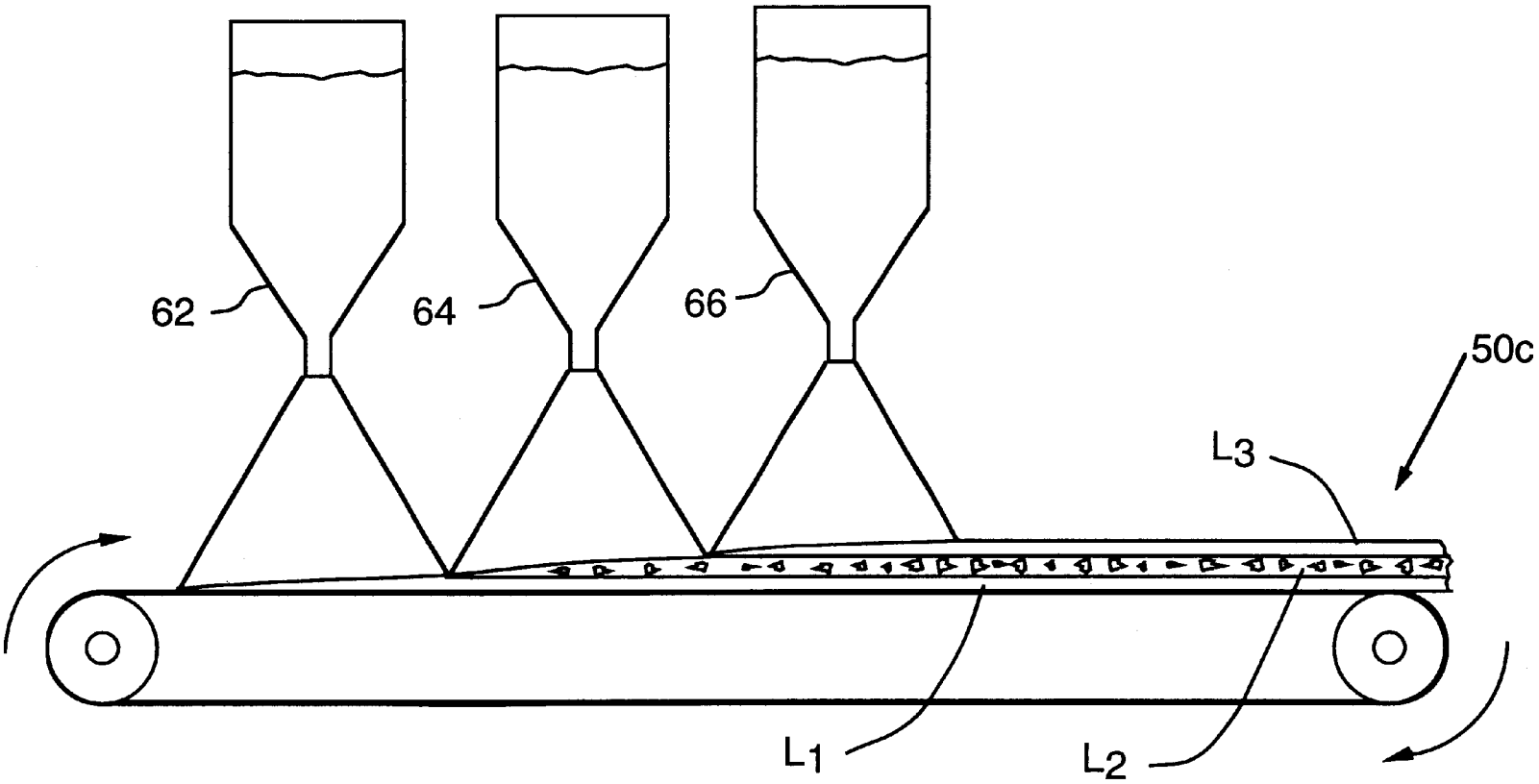
FIG. 5 presents an alternate embodiment wherein is shown a schematical sectional view of a plurality of nozzles being utilized for producing a porous metal having a plurality of layers where the layers can be porous or solid and the layers can also be made from different alloys.

With reference to FIG. 5, there is shown an alternate embodiment of the present invention wherein a plurality of nozzles 62, 64 and 66 are employed for producing a porous metal having a plurality of layers. The parameters effecting the development of macroporosity and microporosity within the porous metal 50 may be adjusted so that each of the individual layers may have a different amount of porosity. For example, the embodiment of FIG. 5 shows a metal foam 50*c* having three layers $L_1$, $L_2$ and $L_3$. In this particular embodiment, layers $L_1$ and $L_3$ are produced by nozzles 62 and 66 respectively, and are such that a low level of porosity is provided to produce essentially porosity free surface layers. In between layers $L_1$ and $L_3$ is porous metal layer $L_2$ which is produced by nozzle 64. Layer $L_2$ is produced with a desired amount of porosity so that the result is a porous metal 50*c*. The porous metal 50*c* may then be subjected to further processing, such as, expansion into a predetermined shape or increasing the internal pressure by rolling or forming into a given shape using the techniques as described herein or by other such techniques which are known.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method for producing a porous metal, comprising the steps of:

providing a molten metal;

injecting a gas into said molten metal to enhance the formation of porosity; and spray casting said molten metal containing said gas onto a surface to produce said porous metal.

2. The method of claim 1, wherein introducing said gas into said molten metal results in the formation of microporosity within said porous metal produced by said spray casting; and controlling the amount of said microporosity formed in said porous metal by controlling the pressure at which said gas is introduced.

3. The method of claim 2, including controlling the amount of said microporosity formed in said porous metal by controlling the temperature of said molten metal while said gas is being introduced.

4. The method of claim 1, wherein said gas is selected from the group consisting of argon, nitrogen, hydrogen, helium, $SF_6$, air, oxygen, $CO_2$ and combinations thereof.

5. The method of claim 1, including said spray casting comprising providing a spray casting apparatus including an atomization nozzle, said nozzle having a discharge opening;

atomizing said molten metal as it is discharged from said nozzle through said discharge opening by subjecting said discharged molten metal to jets of an atomizing gas in order to form metal droplets for deposition onto said surface; and allowing said metal droplets to solidify so as to form said porous metal.

6. The method of claim 5, wherein said atomizing gas is selected from the group consisting of argon, nitrogen, hydrogen, helium, $SF_6$, air, oxygen, $CO_2$ and combinations thereof.

7. The method of claim 5, wherein said spray casting apparatus includes multiple atomization nozzles for producing a multiple layer porous metal, each said layer capable of having different amounts of porosity.

8. The method of claim 5 including introducing solid particles into the spray of said molten metal droplets before depositing said metal droplets onto said surface.

9. The method of claim 5, wherein said subjecting of said atomizing gas to said discharged molten metal results in the formation of macroporosity within said porous metal; and controlling amounts of said macroporosity in said porous metal by controlling the temperature of said atomizing gas to which said discharged molten metal is subjected.

10. The method of claim 9, including controlling amounts of said macroporosity in said porous metal by controlling the pressure of said atomizing gas to which said discharged molten metal is subjected.

11. The method of claim 9, including controlling amounts of said macroporosity in said porous metal by controlling the flow rate of said atomizing gas to which said discharged molten metal is subjected.

12. The method of claim 9 including controlling amounts of said macroporosity in said porous metal by controlling the ratio of said atomizing gas to said discharged molten metal.

13. The method of claim 9, including controlling amounts of said macroporosity in said porous metal by controlling the temperature of said molten metal introduced into said nozzle.

14. The method of claim 1, wherein said molten metal is an aluminum alloy.

15. The method of claim 1, wherein said porous metal contains interconnected porosity.

16. The method of claim 1, wherein said porous metal contains isolated porosity.

17. The method of claim 1, including forming said porous metal into a pre-determined shape by controlling the expansion of porosity in said porous metal, said porosity having said gas entrapped therein.

18. The method of claim 17, wherein said forming includes heating said porous metal.

19. The method of claim 1, including subjecting said porous metal to wrought deformation so as to shape said porous metal.

20. An apparatus for spray casting a molten metal to produce a porous metal, said apparatus comprising:

means for containing the molten metal, said containing means having a discharge end;

means for injecting a gas into said molten metal in said containing means including means for pressurizing gas to enhance the formation of porosity;

molten metal discharge means positioned adjacent said discharge end of said containing means for atomizing said molten metal that is discharged from said discharge end into metal droplets; and a surface on which said metal droplets are deposited in order to form said porous metal.

* * * * *